US005345732A

United States Patent [19]

Knight et al.

[11] Patent Number: 5,345,732

[45] Date of Patent: Sep. 13, 1994

[54] METHOD AND APPARATUS FOR GIVING STRENGTH TO A POLE

[76] Inventors: John K. Knight; Noel W. Murray, both of Suite 292 Westlake Bldgs., 175 S. Mayfair Ave., Daly City, Calif. 94015

[21] Appl. No.: 69,808

[22] Filed: Jun. 1, 1993

[51] Int. Cl.[5] ..... E02D 27/42

[52] U.S. Cl. ..... 52/170; 52/153; 52/154

[58] Field of Search ..... 52/153, 154, 170

[56] References Cited

U.S. PATENT DOCUMENTS

| | | | |
|---|---|---|---|
| 106,375 | 8/1870 | Larkin | 52/153 |
| 1,584,405 | 5/1926 | Spring | 52/170 |
| 1,665,995 | 4/1928 | Wiley | 52/170 |
| 1,673,729 | 6/1928 | Barnes | 52/170 |
| 1,726,371 | 8/1929 | Spring . | |
| 1,811,899 | 6/1931 | Spring . | |
| 1,995,874 | 3/1935 | Van de Mark . | |
| 2,090,972 | 8/1937 | Allen . | |
| 2,176,530 | 10/1939 | Greulich . | |
| 2,265,452 | 12/1941 | Ruggieri . | |
| 2,327,681 | 8/1943 | Vanderveer . | |
| 2,335,227 | 11/1943 | Baron . | |
| 2,358,343 | 9/1944 | Maxey . | |
| 3,295,275 | 1/1967 | Carlsen | 52/170 |
| 3,309,824 | 3/1967 | Barrett . | |
| 3,320,714 | 11/1967 | Barrett . | |
| 3,350,822 | 9/1965 | Nachazel . | |
| 3,625,463 | 12/1971 | Scholz . | |
| 3,662,505 | 5/1972 | Watanabe et al. . | |
| 3,738,072 | 5/1973 | Adrian . | |
| 3,785,107 | 1/1974 | Garretson . | |
| 3,903,662 | 9/1975 | Gabliya et al. . | |
| 4,516,365 | 5/1985 | Chapman . | |
| 4,697,396 | 10/1987 | Knight | 52/170 |
| 4,987,718 | 1/1991 | Knight | 52/170 X |

FOREIGN PATENT DOCUMENTS

| | | |
|---|---|---|
| 571232 | 4/1988 | Australia . |
| 819575 | 7/1949 | Fed. Rep. of Germany . |
| 269511 | 11/1929 | Italy . |

*Primary Examiner*—Carl D. Friedman
*Assistant Examiner*—Kevin D. Wilkens
*Attorney, Agent, or Firm*—Frank P. Presta

[57] ABSTRACT

A method of giving strength to a pole comprising taking a nail comprising two longitudinally extending metal sections generally of L-shape cross-section, wherein the two sections are secured together so that, in cross-section, the nail is generally of T-shape, driving the nail into the ground adjacent the pole with the cross-bar of the T-shape adjacent the pole and the upright of the T-shape extending generally radially of the pole, and fastening the nail to the pole.

22 Claims, 8 Drawing Sheets

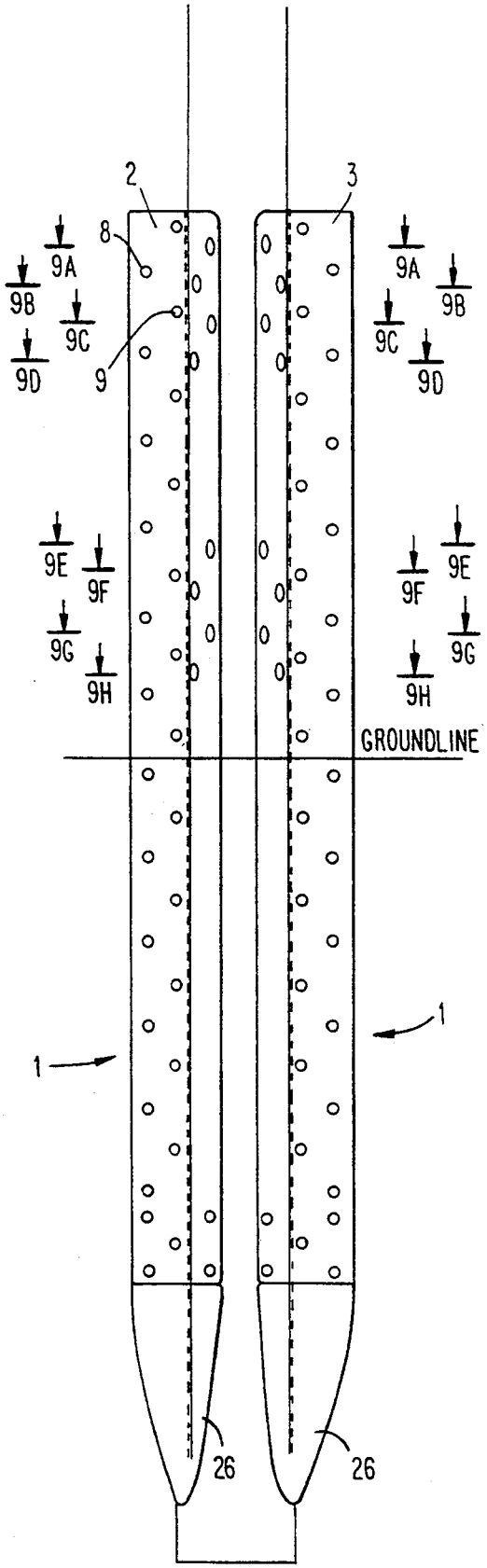
FIG. 1
FIG. 3
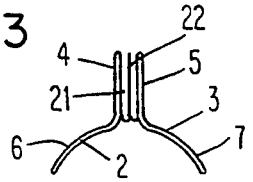
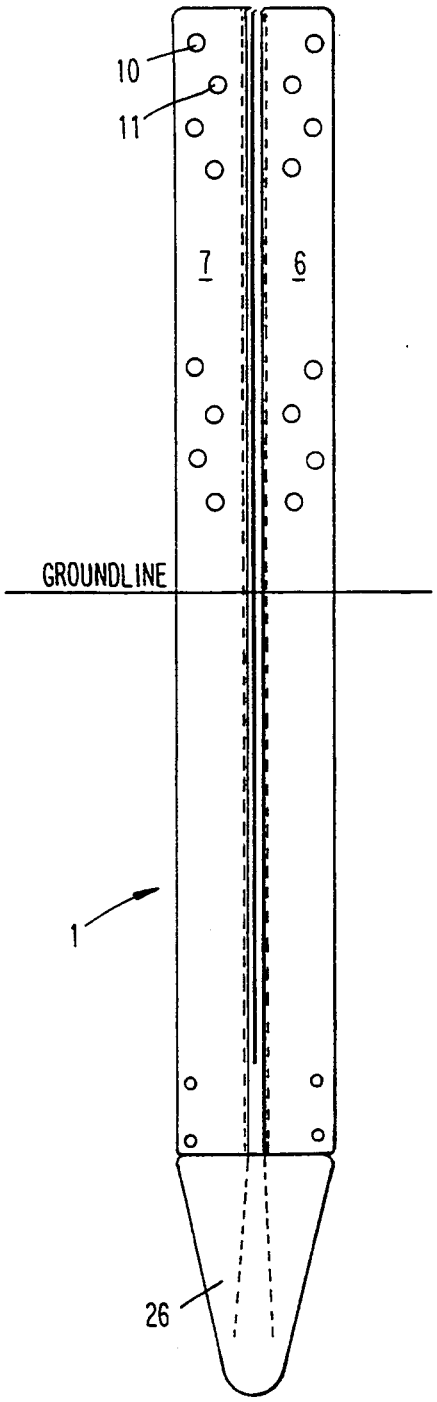
FIG. 2

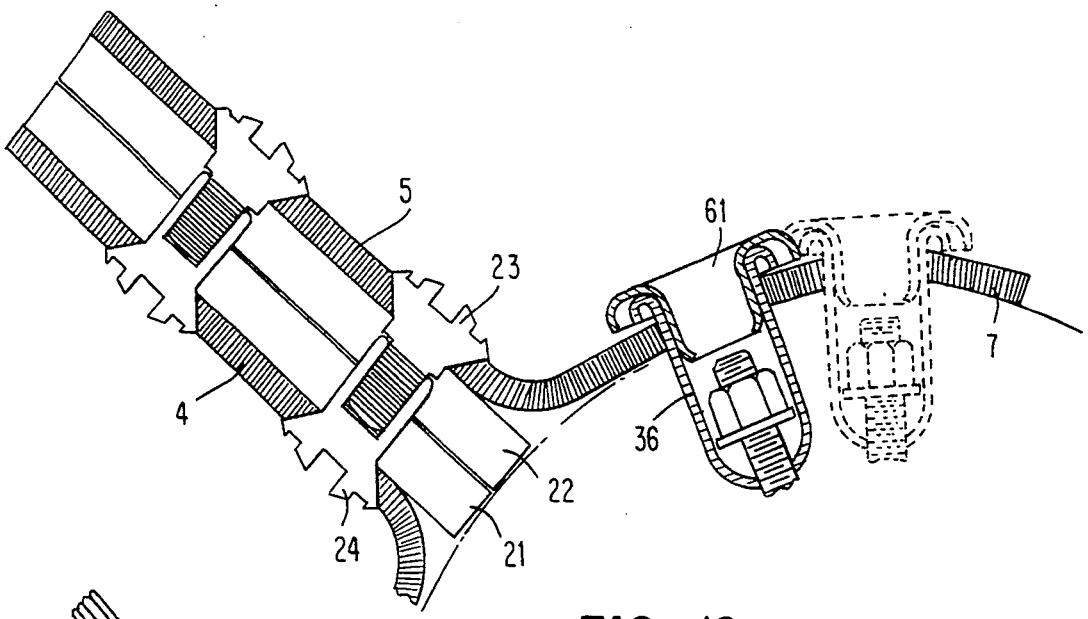
FIG. 10
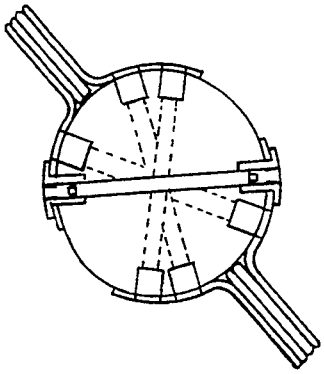
FIG. 9A
(SECTIONS 9B, 9C, 9D, 9E, 9F, 9G, 9H SIMILAR)
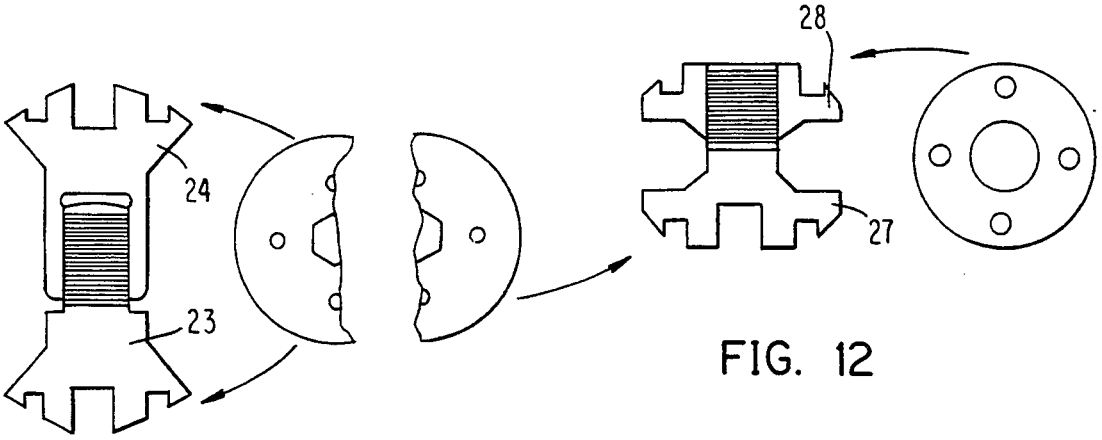
FIG. 12
FIG. 11

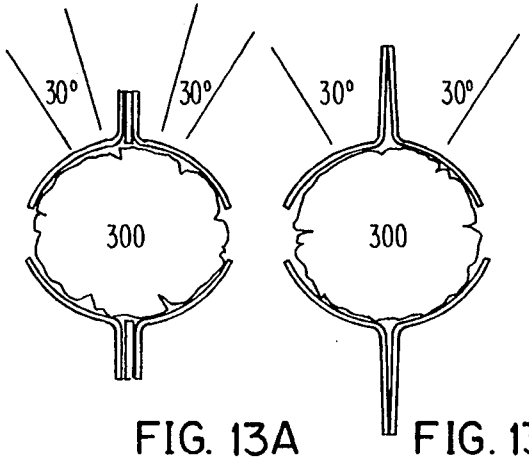
FIG. 13A
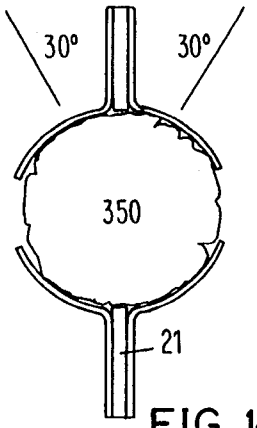
FIG. 13B
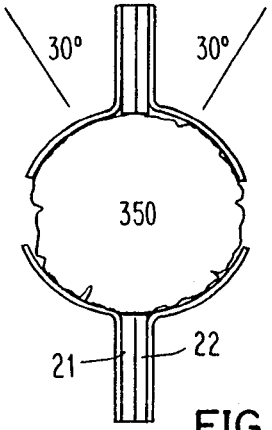
FIG. 14
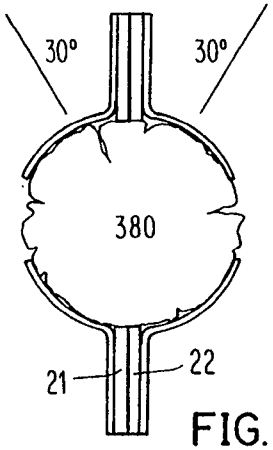
FIG. 15
FIG. 16
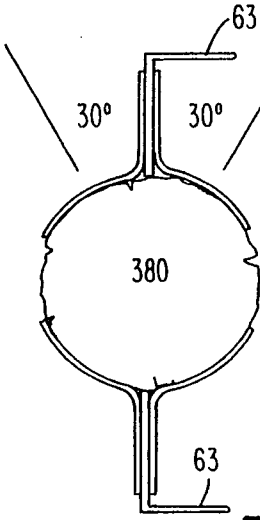
FIG. 17
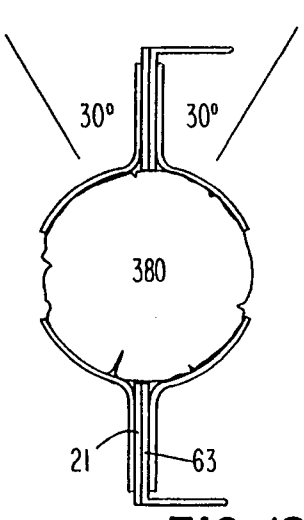
FIG. 18
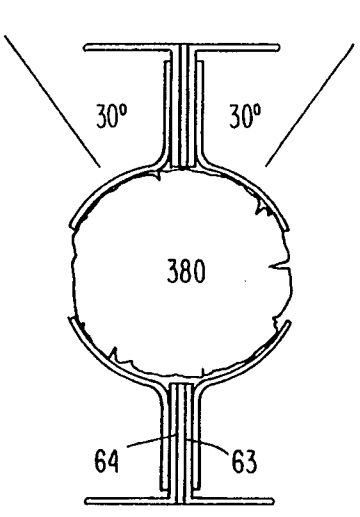
FIG. 19

METHOD AND APPARATUS FOR GIVING STRENGTH TO A POLE

FIELD OF THE INVENTION

This invention relates to a method and apparatus for giving strength to a pole.

The present invention has particular application to poles used for carrying telecommunications lines and electrical power lines but has application also to other forms of poles.

It is estimated that there are more than 200 million wooden power and telephone poles distributed throughout North America.

A wooden pole is most vulnerable to the elements in the area slightly above to slightly below the ground line and that is the area in which rot generally begins and where decay grows until the pole is weakened. Typically that area is where a wooden pole will fail.

Present tests in practice not only condemn some approximately 30% of poles unnecessarily, but also leave dangerous poles undetected.

If a pole should fail, there will be serious disruption to telecommunications and electric power supply.

Further, sudden failure of a pole is one of the risks every telecommunications or electric power linesman faces every day when working on poles. There are many instances of a faulty pole failing and taking the linesman down with it. There are also risks to passers-by.

When it is considered that ground line degradation of a pole usually effects less than 5% of the length of the pole it seems not to make economic sense to throw out 95% of good pole if repair of a faulty pole is possible.

While the life of a pole is typically 20–30 years, it takes around 30 years for a tree to grow to a size to be suitable for use as a pole. Thus it is easy to see that the rate of usage is likely to exceed the rate of re-supply.

The present invention relates to a method and apparatus for giving strength to a pole and in the art this is commonly referred to as "re-instatement" of a pole which approximately means that by giving strength to an existing pole its life can be prolonged and thus it may be considered as "re-instated". Accordingly, in parts of the specification the words "re-instate" and grammatical derivatives is used as a simple and handy form of referring to methods and apparatus for giving strength to a pole.

In a particular aspect this invention relates to an apparatus for giving strength to a pole and in the art, prior apparatus has commonly been referred to as "nail". While the word "nail" may not be highly appropriate, since it is a term well used in the art it is also used in this specification but should not be considered as unduly limiting.

PRIOR ART

Applicants are aware of Australian Patent Specification No. 571232 and U.S. Pat. No. 4,697,396.

Those specifications disclose nails useful in the re-instatement of poles and the products described therein have been found to have wide acceptance in industry.

However, the nails described therein are not particularly effective at strengthening very large poles and are expensive to produce.

Large poles are those which project 20 meters or more out of the ground or which have a diameter of 300 mm or more.

Applicants now believe that they can produce a new nail which has certain advantages with respect to tall poles or those of large diameter, which has certain conveniences with respect to poles other than tall poles and which have certain economics in manufacture, use and effectiveness.

SUMMARY OF THE INVENTION

The present invention provides a method of giving strength to a pole comprising taking a nail comprising two longitudinally extending metal sections generally of L-shape cross-section, wherein the two sections are secured together so that, in cross-section, the nail is generally of T-shape, driving the nail into the ground adjacent the pole with the cross-bar of the T-shape adjacent the post and the upright of the T-shape extending generally radially of the pole, and fastening the nail to the pole.

The present invention also provides the combination of the aforesaid nail with a pole.

The present invention also provides in use of the method above, the aforesaid nail.

The present invention also provides the aforesaid nail.

PREFERRED ASPECTS OF THE INVENTION

Preferably fasteners are passed through apertures in the limbs of the L-shapes which form the cross-bar of the T-shape to fasten the nail to the pole.

Preferably the fasteners deform said limbs of the L-shapes which from the cross-bar to at least generally conform to the shape of the pole.

Preferably the limbs of the L-shapes which form the cross-bar are shaped to generally conform to the shape of the pole and wherein the fasteners deform said limbs of the L-shapes which form the cross-bar to cause those limbs to more closely conform to the shape of the pole.

Preferably the limbs of the L-shapes which form the cross-bar of the T-shape are curved at a radius equal to the average radius of the pole $\pm 20$ mm.

Preferably the limbs of the L-shapes which form the cross-bar of the T-shape are curved at a radius equal to about $150 \pm 40$ mm.

Preferably the limbs of the L-shapes which form the cross-bar of the T-shape are curved at a radius equal to about 150 mm.

In one instance the limbs of the L-shapes which form the upright of the T-shape are secured together limb-to-limb.

In another instance the limbs of the L-shapes which form the upright of the T-shape are secured together spaced apart by one or more strengthening members.

Two such strengthening members are preferred in some instances.

The strengthening member may be of rectangular cross-section or may be of angle cross-section.

When angle cross-section strengthening members are used their limbs are preferably disposed in an orientation which tend to better resist bending.

In one instance the limbs of the L-shapes which form the cross-bar of the T-shape taperingly narrow towards a ground entering end.

In another instance the limbs of the L-shapes which form the upright of the T-shape taperingly narrow towards a ground entering end.

In another instance the metal sections are of substantially constant cross-section throughout their length.

Preferably the limbs of the L-shapes which form the cross-bar of the T-shape have a length in cross-section of not less than 150 mm and preferably a thickness of not less than 4 mm.

Preferably the limbs of the L-shapes which form the upright of the T-shape have a length in cross-section of not less than 150 mm and a thickness of not less than 4 mm.

The present invention has most economic application to poles having a diameter of 250 mm or greater but can be easily adapted in respect of lesser sizes.

The nails preferably have a length in excess of 2000 mm and in excess of 3000 mm is more preferred.

Preferably the limbs of the L-shapes which form the cross-bar of the T-shape have apertures through which the fasteners can be passed into the poles.

Preferably those apertures are staggered in spaced apart vertical lines.

Preferably the securing together of the two sections is by securing means for the sections which pass through holes in the limbs of the L-shapes forming the upright of the T-shape.

Preferably those holes are staggered in spaced apart vertical lines.

Preferably the securing means for the sections which will be below ground, in use, are smooth ended, round headed, otherwise shaped or substantially flush with the limbs through which they pass so as to reduce drag in entering the ground.

Preferably there is a pointed member secured to the ground entering end of the nail to facilitate ground entry during the driving.

Preferably the pointed member is a unitary, integrally formed member.

Preferably the pointed member is so shaped so that during the driving the pointed member will move with a component of motion towards the pole.

Preferably the pointed member is secured to the nail by means of securing means for the pointed member which are smooth ended, round headed, otherwise shaped or substantially flush with the limbs through which they pass so as to reduce drag in entering the ground.

Preferably the securement of the sections and the pointed member is of such close tolerance to make it unlikely that the securement is significantly weakened as the nail is driven in to the ground.

Preferably the pointed member is mounted to transmit a substantial amount of load on it in ground entering to an end or ends of the strengthening members.

Preferably the pointed member is secured to a load transmitting member adapted to transmit load on ground entering to an end or ends of the strengthening members.

Preferably the pointed member has a portion which is located between the limbs of the L-shapes forming the upright of the T-shape.

Preferably the fasteners comprise connectors having a cylindrical body portion which, in use, locates within the pole, an inner end having a hole and an annular flange at the outer end which bears, in use, on one of the limbs of the L-shapes which form the cross-bar of the T-shape, a bolt received in the connector and passing through the pole and a nut; one of the bolt and the nut bearing on said inner end.

Preferably a strengthener for the connector is provided and comprises a sleeve tight fitting within the connector.

Preferably the sleeve has an annular flange on its outer end.

As many nails of the above type as may be desired may be used to secure a pole but in practical terms one or two nails are most likely to be used.

In this last respect, it has been found by tests that two nails are approximately twice as strong as one nail.

A specific construction of a nail in accordance with this invention and its preferred manner of use will now be described with the aid of the accompanying drawings.

BRIEF DESCRIPTION OF THE VIEWS OF THE DRAWINGS

FIG. 1 is a left and right hand side elevation of the nail,

FIG. 2 is an elevational view of the nail,

FIG. 3 is a top plan view of the nail,

FIG. 9 is a cross-sectional view showing two nails in accordance with this invention secured to a pole, FIG. 10 is a cross-sectional view showing a nail in accordance with this invention, FIG. 11 shows a nail bolt in cross-sectional view and also in plan view, FIG. 12 shows another bolt in cross-sectional view and in plan view, and FIGS. 13A–19 show nails in accordance with this invention in various forms and configuration and in association with poles of differing size.

INTEGER LIST

Figure 4:
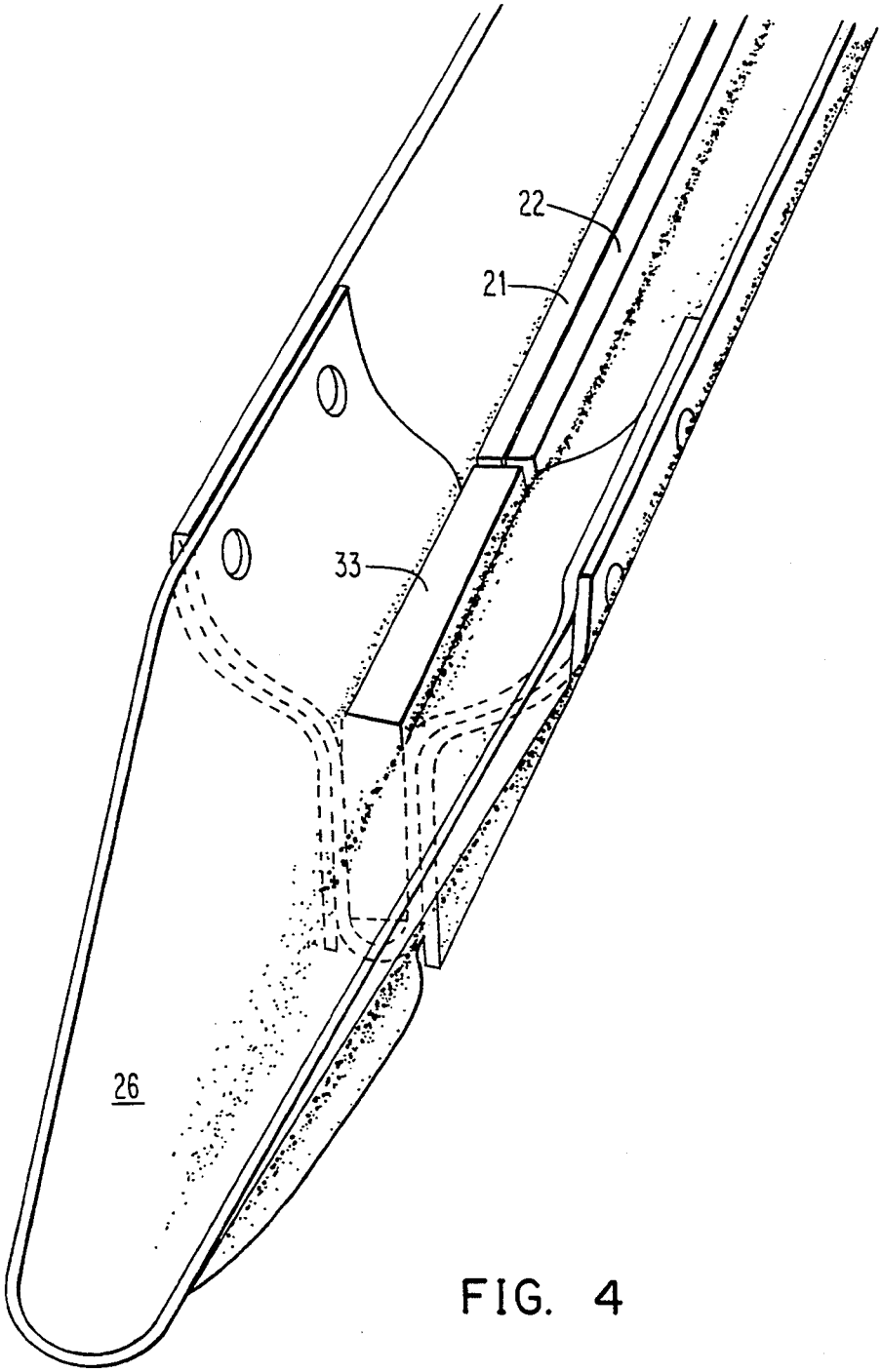
FIG. 4 is an isometric view of one end of the nail.
Figure 5:
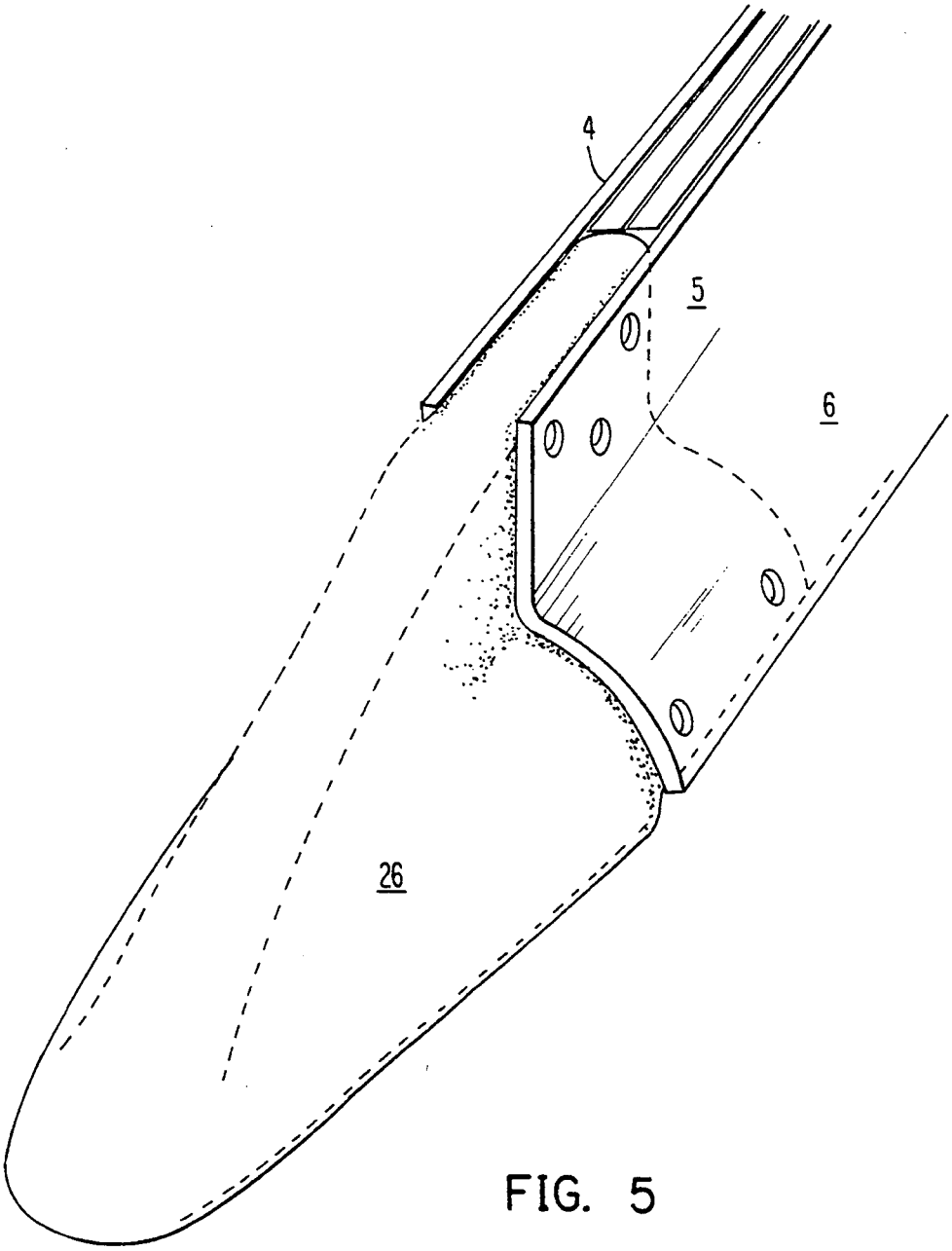
FIG. 5 is an isometric view of said one end but from an opposite side.

1. Nail
2. L-shaped length
3. L-shaped length
4. Limb (upright of T-shape)
5. Limb (upright of T-shape)
6. Limb (cross-bar of T-shape)
7. Limb (cross-bar of T-shape)
8. Holes
9. Holes
10. Holes
11. Holes
21. Strengthening member
22. Strengthening member
23. Bolts
24. Nuts
26. Ground entering end (slipper)
27. Bolts
28. Nuts
31. Pole
32. Pole
33. Strengthening member
36. Connectors 37. Inner end
38. Annular flange
41. Holes
51. Bolts
52. Heads
53. Washers
54. Shanks
56. Threading
57. Washers
58. Nuts
61. Sleeves
62. Annular flanges
63. Strengthening member
64. Strengthening member

DETAILED DESCRIPTION WITH RESPECT TO THE DRAWINGS

In FIGS. 1–6 is shown a nail indicated generally by reference numeral 1.

The nail is comprised of two generally L-shaped lengths (2 and 3) formed of metal wherein two of the limbs (4 and 5) are secured together to form the upright of a T-shape when seen in end view and two of the limbs 6 and 7 extend away from one another to generally define the cross-bar of the aforesaid T-shape.

The limbs 6 and 7 are curved on a radius of approximately 150 mm as this size has been found to suit a large variety of sizes of poles. The dimension is not, however, critical nor is any other dimension which is shown in the drawings and such dimensions as have been given are more for illustrative purposes than for any reason of limitation.

Each of the limbs 4 and 5 is provided with a plurality of holes which are offset or staggered relative to one another. One group of holes, referenced 8, are in one line and another group of holes, referenced 9 are in another line.

The limbs 6 and 7 similarly have holes 10 and 11 which are also staggered with respect to one another in two lines.

Located between the limbs 4 and 5 are two strengthening members 21 and 22. The limbs 4 and 5 and the strengthening members 21 and 22 are held together with bolts 23 and nuts 24 as shown in FIG. 11.

The bolts 23 and nuts 24 are relatively smooth headed so as to produce relatively little friction when driven into the ground and also so as to provide no ready surface for catching on personnel or equipment.

At the lower end with respect to FIGS. 1 and FIGS. 2, the nails 1 have a pointed ground entry end 26 which is sometimes known as a slipper.

That slipper is of pressed metal construction and is secured to lengths 2 and 3 by means of bolts 27 and nuts 28 as shown in FIG. 12.

Once again, the bolts 27 and nuts 28 have a relatively rounded outer end so as to cause little obstruction in entering the ground.

Figure 6:
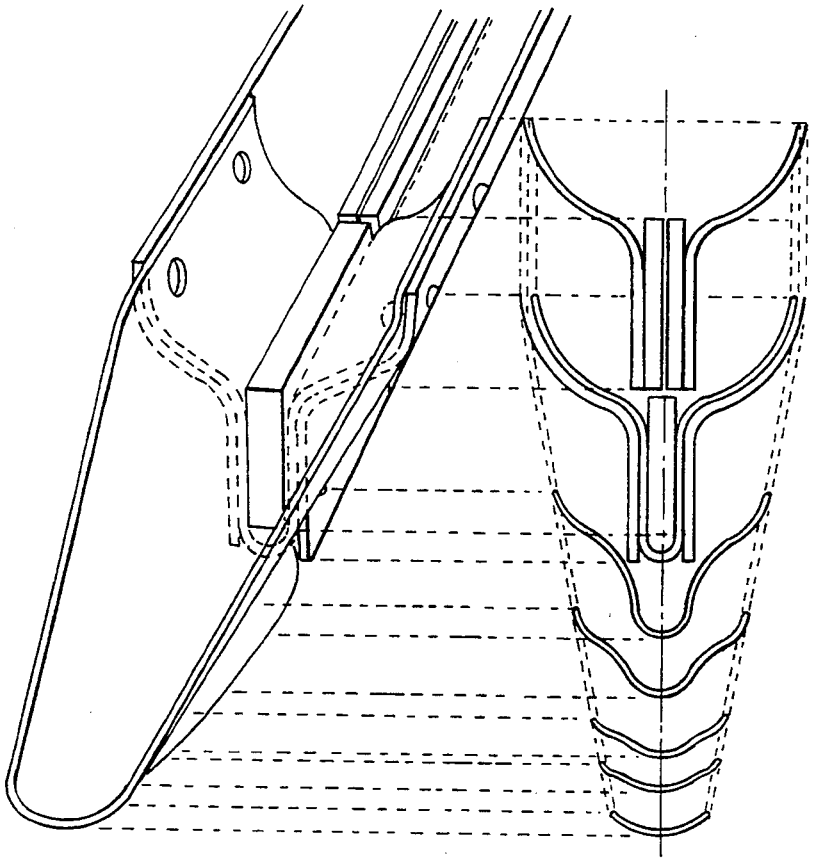
FIG. 6 is an isometric view corresponding to FIG. 4 but additionally showing cross-sections at lines indicated by dash lines.
Figure 7:
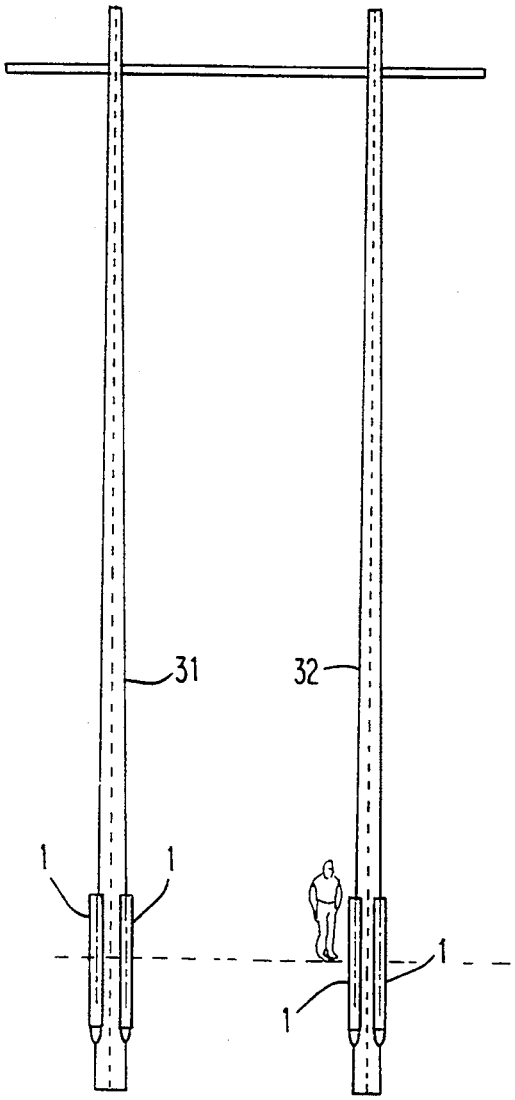
FIG. 7 is an elevational view indicating the general manner of use of the nail.

The ground entering end 26 is so shaped as is better shown in FIG. 6 such that when it is driven into the ground adjacent a pole such as is shown in FIG. 7 there will be a tendency for the ground entering end 26 to move to closely lie alongside the pole 31 or the pole 32 shown in FIG. 7.

To strengthen the ground entering end 26 it may be provided with a strengthening member 33 as shown in FIG. 4.

Figure 8:
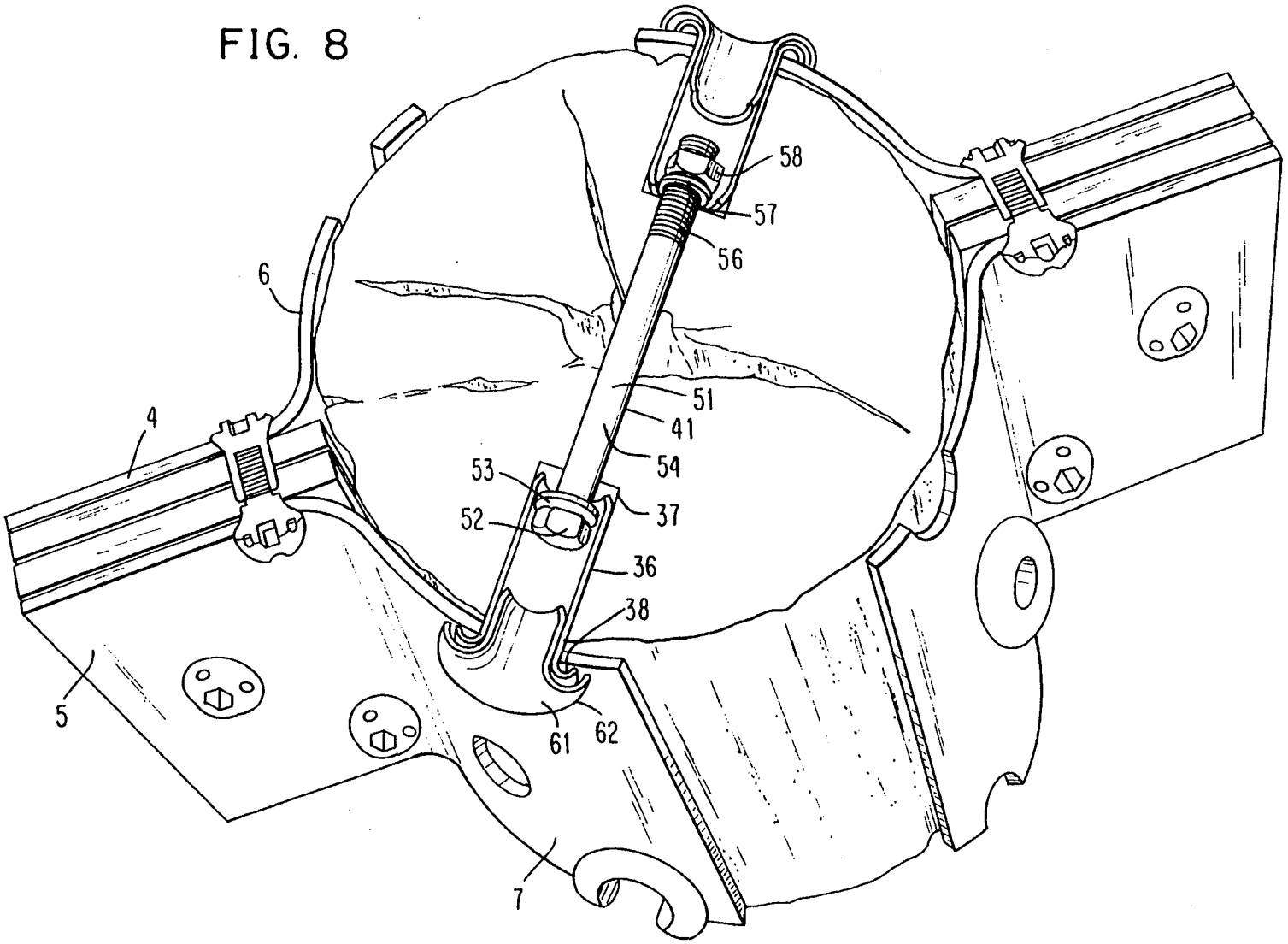
FIG. 8 is a fragmentary cross-sectional view showing two of the nails in accordance with this invention secured to a pole.

In use, one or more of the nails 1 may be driven in adjacent a pole 31 or a pole 32 as shown in FIG. 7 and will have approximately the appearance as shown in FIG. 8.

The driving may be done by a drop hammer or by any convenient tool several of which are commercially available at this time.

After driving of the nails 1, a drill is passed through certain selected ones of the holes 10 and 11 to drill into the pole 31 or 32.

Thereafter connectors are passed into the so-drilled holes.

The connectors 36 have a narrow inner end 37 and an annular flange 38 at the outer end.

The flanges bear on a substantial area of the limbs 6 and 7.

Holes are further drilled through the pole 31 and these have been given reference numeral 41.

Bolts 51 with heads 52, washers 53, shanks 54, threading 56, washers 57 and nuts 58 are then inserted as is shown in FIG. 8 and tightened.

To further strengthen the connectors 36, sleeves 61 which are a tight fit within the connectors 36 are pushed into the connectors 36.

The sleeves 61 have annular flanges 62 which will bear on the limbs 6 and 7 to distribute load.

The nails of the present invention can be supplied in a number of configurations to suit different size poles and some of the possible configurations are shown in FIGS. 13A and 13B–19.

Referring to FIGS. 13A and 13B, to suit a 300 mm diameter pole it is sufficient if the nail does not have the strengthening members 21 and 22.

As shown in FIG. 14, to suit a 350 mm pole, it is desirable that only one of the strengthening members 21 and 22 is present.

The suit another 350 mm diameter pole it may be desirable to have both strengthening members 21 and 22 present as is shown in FIG. 15.

FIG. 16 shows a nail with two strengthening members 21 and 22 in use with respect to a 380 mm pole.

FIG. 17 shows an alternative configuration in which a strengthening member 63 is used in lieu of the strengthening members 21 and 22 but in this instance the strengthening member 63 is of angle construction.

FIG. 18 shows yet a further construction in which the strengthening member 63 is used but additionally the strengthening member 21 is also used.

FIG. 19 shows a still further construction in which the strengthening member 63 is used but there is an additional strengthening member 64 which is also of angle construction.

Applicant has found that they can make nails which are of superior strength to those previously made and which are useful for supporting very large and tall poles but when applied in respect of not very tall poles still offer various configurational and material advantages for use.

Finally it is to be understood that various alterations, modifications and/or additions may be incorporated into the various constructions and arrangements of parts without departing from the spirit and ambit of the invention.

The claims and drawings form part of the disclosure of this specification.

We claim:

1. A method of giving strength to a pole comprising the steps of:

i) taking a nail comprising;

a) two longitudinally extending metal sections generally of L-shape cross section, wherein the two sections are secured together so that, in cross-section, the nail is generally of T-shape, wherein each metal section has apertures positioned in a first limb forming part of a cross bar of said T-shape and wherein second limbs of the L-shapes which form the upright of the T-shape are secured together spaced apart by one or more strengthening members, and b) fasteners sized to extend through said pole and through aligned apertures of opposing longitudinally extending metal sections, ii) driving the nail into the ground adjacent the pole with the cross-bar of the T-shape adjacent the pole and the upright of the T-shape extending generally radially of the pole, and iii) fastening the nail to the pole using said fasteners.

2. A method as claimed in claim 1, wherein said taking step further comprises taking the nail wherein the limbs of the L-shapes which form the cross-bar of the T-shape are curved at a radius equal to the average radius of the pole ±20 mm.

3. A method as claimed in claim 1, wherein said taking step further comprises taking the nail wherein the limbs of the L-shapes which form the upright of the T-shape are secured together limb-to-limb.

4. A method as claimed in claim 1, wherein said taking step further comprises taking the nail wherein the limbs of the L-shapes which form the cross-bar of the T-shape have a length in cross-section of not less than 150 mm and a thickness of not less than 4 mm.

5. A method as claimed in claim 1, wherein said taking step further comprises taking the nail wherein the apertures are staggered in spaced apart vertical lines.

6. A method as claimed in claim 1, wherein said taking step further comprises said sections being secured together below ground by bolts which are smooth ended, round headed, and shaped to be substantially flush with the limbs through which they pass so as to reduce drag in entering the ground.

7. A method as claimed in claim 1, wherein said taking step further comprises taking the nail wherein each said fastener comprises a pair of connectors, each connector having a cylindrical body portion with a hole at an inner end thereof and an annular flange at an outer end thereof, a nut and bolt, said bolt extending through each said hole.

8. A method as claimed in claim 7, wherein said taking step further comprises taking a nail having a sleeve for each connector, each sleeve sized to tightly engage the outer end of the connector and having an annular flange on its outer end.

9. A method as claimed in claim 1, wherein said taking step further comprises taking the nail having a pointed member sized at one end to removably attach to a ground entering end of the nail and terminating at the other end at a pointed portion to facilitate ground entry during the driving, the pointed member being a unitary, integrally formed member, shaped so that during the driving the pointed member will move with a component of motion towards the pole.

10. A method as claimed in claim 9, wherein said taking step further comprises taking the nail wherein the pointed member is secured to the nail by securing means which are smooth ended, round headed, and shaped to be substantially flush with the limbs through which they pass so as to reduce drag in entering the ground.

11. A method as claimed in claim 10, wherein said taking step further comprises taking the nail wherein securement of the sections and the pointed member is of such close tolerance to make it unlikely that the securement is significantly weakened as the nail is driven in to the ground.

12. A method as claimed in claim 9, wherein said taking step further comprises taking the nail wherein the pointed member is mounted to transmit a substantial amount of load on it in ground entering to an end or ends of the strengthening members.

13. A method as claimed in claim 12, wherein said taking step further comprises taking the nail wherein the pointed member is secured to a load transmitting member adapted to transmit load on ground entering to an end or ends of the strengthening members.

14. A nail for giving strength to a pole comprising two longitudinally extending metal sections generally of L-shape cross-section, wherein the two sections are secured together so that, in cross-section, the nail is generally of T-shape, wherein each metal section has apertures positioned in a first limb forming cross bar of said T-shape and wherein second limbs of the L-shapes which form the upright of the T-shape are secured together spaced apart by one or more strengthening members, and wherein the nail is adapted to be driven into the ground adjacent the pole with the cross-bar of the T-shape adjacent the pole and the upright of the T-shape extending generally radially of the pole, and fasteners sized to extend through said pole and through aligned apertures of opposing longitudinally extending metal sections, said fasteners securing said metal sections to the pole.

15. A nail as claimed in claim 14, wherein the apertures are staggered in spaced apart vertical lines.

16. A nail as claimed in claim 14 wherein the sections which will be below ground are secured together by bolts which are smooth ended, round headed, and shaped to be substantially flush with the limbs through which they pass so as to reduce drag in entering the ground.

17. A nail as claimed in claim 14, further comprising a pointed member sized at one end to removably attach to a ground entering end of the nail and terminating at the other end at a pointed portion to facilitate ground entry during the driving, the pointed member being a unitary, integrally formed member shaped so that during the driving the pointed member will move with a component of motion towards the pole.

18. A nail as claimed in claim 17, wherein the pointed member is secured to the nail by means of securing means for the pointed member which are smooth ended, round headed, and shaped to be substantially flush with the limbs through which they pass so as to reduce drag in entering the ground.

19. A nail as claimed in claim 17 wherein the pointed member is secured to a load transmitting member adapted to transmit load on ground entering to an end or ends of the strengthening members.

20. The nail of claim 14, wherein each said fastener comprises a pair of connectors, each connector having a cylindrical body portion with a hole at one inner end thereof and an annular flange at an outer end thereof, a nut and bolt, said bolt extending through each said hole, and a sleeve with an annular flange, said sleeve sized to fit within said cylindrical body portion at said outer end.

21. A nail for giving strength to a pole comprising two longitudinally extending metal sections generally of L-shape cross-section, wherein the two sections are secured together so that, in cross-section, the nail is generally of T-shape, and wherein the nail is adapted to be driven into the ground adjacent the pole with the cross-bar of the T-shape adjacent the pole and the upright of the T-shape extending generally radially of the pole, and fasteners for fastening said metal sections to the pole, each said fastener comprising a pair of connectors, each connector having a cylindrical body portion with a hole at one inner end thereof and an annular flange at an outer end thereof, a nut and bolt, said bolt extending through each said hole, and a sleeve with an annular flange, said sleeve sized to fit within said cylindrical body portion at said outer end thereof.

22. A nail for giving strength to a pole comprising two longitudinally extending metal sections generally of L-shape cross-section, wherein the two sections are secured together so that, in cross-section, the nail is generally of T-shape, and wherein the nail is adapted to be driven into the ground adjacent the pole with the cross-bar of the T-shape adjacent the pole and the upright of the T-shape extending generally radially of the pole, fasteners for fastening said metal section to the pole and a pointed member sized at one end to removably attach to a ground entering end of the nail and terminating at the other end at a pointed portion to facilitate ground entry during the driving, the pointed member being a unitary, integrally formed member and being shaped so that during the driving the pointed member will move with a component of motion towards the pole.

* * * * *